United States Patent [19]

Danko

[11] Patent Number: 4,462,788

[45] Date of Patent: Jul. 31, 1984

[54] METHOD FOR USING ALCOHOL TO REDUCE NITROGEN OXIDES IN A FUEL GAS

[75] Inventor: Edward A. Danko, Rolling Hills, Calif.

[73] Assignee: Southern California Edison, Rosemead, Calif.

[21] Appl. No.: 519,330

[22] Filed: Aug. 1, 1983

[51] Int. Cl.[3] ..... F23M 3/02

[52] U.S. Cl. ..... 431/8; 431/10

[58] Field of Search ..... 431/2, 8, 10

[56] References Cited

U.S. PATENT DOCUMENTS 3,890,084 6/1975 Voorheis et al. ..... 431/10

4,095,928 6/1978 Jones et al. ..... 431/8

4,395,223 7/1983 Okigami et al. ..... 431/175

OTHER PUBLICATIONS

Test and Evaluation of Methanol in a Gas Turbine System, Weir, Jr., et al., EPRI, Feb. 1981—Distributed by Research Reports Center, Box 50490, Palo Alto, CA 94303.

*Primary Examiner*—Carroll B. Dority, Jr.

*Attorney, Agent, or Firm*—Jeffrey G. Sheldon

[57] ABSTRACT

Nitrogen oxide emissions from burning a gas containing essentially no nitrogen such as natural gas are reduced by burning the gas simultaneously with an alcohol such as methanol.

14 Claims, No Drawings

METHOD FOR USING ALCOHOL TO REDUCE NITROGEN OXIDES IN A FUEL GAS

BACKGROUND

The present invention relates to a method for reducing emissions of nitrogen oxides from the burning of a fuel that contains essentially no nitrogen.

In recent years, there has been a growing concern over the problem of air pollution. One of the most serious pollutants is the oxides of nitrogen such as NO and $NO_2$, hereinafter referred to collectively as "NOx".

A source of NOx emissions is fuel burning plants such as power generating plants, incinerators, etc. In fuel burning plants, there are two sources of NOx emissions. The first source originates from thermal fixation of atmospheric nitrogen at the elevated temperatures obtained during combustion process. The second source of NOx emission originates from the thermal conversion of some of the organically-bound nitrogen in the hydrocarbon fuel to NOx during the combustion process. Because of the first source of NOx emissions, even when burning a fuel containing essentially no nitrogen such as natural gas, NOx emissions result.

One prior method of reducing nitrogen oxide emissions in flue gas is described in U.S. Pat. No. 4,095,928 issued to Jones et al., which is incorporated herein by this reference. According to that patent, a nitrogen-rich fuel is burned in a first burner and a nitrogen-poor fuel is burned in a second burner which is positioned above the first burner so that combustion gases from burning the nitrogen-rich fuel pass through the combustion zone of the second burner. The Jones et al. process results in combustion effluents having reduced NOx concentrations compared with the combustion of a homogenous mixture of the two fuels.

The Jones et al. process is directed to fuels containing nitrogen. There is a need for reducing NOx emissions from fuel containing essentially no nitrogen such as natural gas.

SUMMARY

The present invention is directed to a method that satisfies this need in that it reduces nitrogen oxide emissions from burning a fuel containing essentially no nitrogen. In the method, the fuel containing essentially no nitrogen is burned in a first burner means. Simultaneously an alcohol, preferably methanol, is burned in a second burner means. The second burner is positioned vertically spaced apart below the first burner means so that the combustion gases from burning the fuel containing essentially no nitrogen pass through the combustion zone of the second burner means. The process results in combustion effluents having NOx concentrations lower that that from burning the fuel containing essentially no nitrogen alone.

In a preferred method, the fuel containing essentially no nitrogen is burned in a fuel-rich manner and the methanol is burned in a stoichiometric or air-rich manner.

The present invention will become better understood with reference to the following description and appended claims.

DESCRIPTION

The present invention is directed to a process for reducing NOx emissions from fuel burning plants comprising simultaneous combustion of (a) a fuel containing essentially no nitrogen and (b) an alcohol. The present invention will be described in considerable detail with reference to using natural gas as the fuel containing essentially no nitrogen and methanol as the alcohol. However, it should be realized that other fuels containing essentially no nitrogen and other alcohols can be used. For example, the present invention is useful with synthetic natural gas from coal gasification; or low or medium BTU gas from gasification of coal, petroleum coke and oils slurries thereof, tar sands, or coal liquefication residue. Further, the present invention is useful with ethanol, propanol, iso-propanol, butanol and other alkyl alcohols.

In the process, combustion of the natural gas occurs in a first group of burners. The methanol is burned simultaneously in a second group of burners which are positioned above the first group of burners so that the combustion gases from the burning of the natural gas pass through the combustion zone of the second group of burners.

In a preferred embodiment, the process is carried out with the natural gas and the methanol in a furnace having two separate burners which are vertically spaced apart. In one embodiment, all stoichiometric combustion is used where the natural gas is burned in a lower burner in a fuel-rich manner and the methanol is simultaneously burned in an upper burner in a stoichiometric or air-rich manner. Alternatively, combustion can occur in a stoichiometric manner.

Suitable furnaces for use in the practice of the present invention are provided with a plurality of burners or sets of burners which are spaced apart and positioned such that the combustion gases from a first burner or set of burners pass through the combustion zones of successive burners or sets of burners. Preferably, the burners are positioned above each other to enable the combustion gases to pass through the combustion zone of successive burners by virtue of convective currents within the furnace. Each burner or set of burners is provided with its own fuel supply pipe. Thus each burner or set of burners can be supplied with a specified type of fuel. Specific types of fuels can easily be stored or segregated in specific tanks or storage areas. Suitable furnaces for the practice of the present invention include solid, liquid and gas burning boilers, gas turbine combustors, fluidized bed, entrained bed or rotating bed reactors. Other types of suitable furnaces can also be utilized in the practice of the present invention.

In the practice of the present invention it is preferred that the natural gas or other fuel containing substantially no nitrogen be burned in the fuel-rich manner while the methanol be burned in a stoichiometric or air-rich manner.

In normal or stoichiometric combustion, the fuel is burned in an atmosphere containing about 115% of the theoretical amount of air necessary to enable complete combustion. In the fuel-rich combustion, natural gas is preferably burned in an atmosphere containing about 80 to about 105% of the theoretical amount of air needed for complete combustion with 90% being generally optimum. In air-rich combustion, the fuel is preferably burned in an atmosphere containing about 120 to about 150% of the theoretical amount of air necessary to enable complete combustion. Preferably, the average value of the amount of air which is passed into the furnace is about 115% of the theoretical amount of air necessary to enable complete combustion of all of the fuel. Thus, when two sets of burners are used with equal amounts of fuel provided to each set, and when the fuel-rich combustion is conducted at about 90% of the air, the air-rich combustion would be maintained at about 140% of the theoretical amount of air necessary to enable complete combustion of all of the fuel.

Fuel-rich or air-rich combustion can be accomplished by either closing down or opening up the air dampers surrounding the burners, thereby enabling a proper amount of air to enter the furnace. The flow rates of fuel through the bottom fuel-rich burners can also be increased and conversely decreased in the top burners to create the proper combustion conditions with equal amounts of air being supplied to all the burners. Various adjustments of air and fuel flow rates between top and bottom burners can also be used to achieve the proper combustion conditions.

In another alternative embodiment, in a three or more burner set furnace, the natural gas can be burned in a fuel-rich manner in the lower set of burners and the methanol can be burned in a stoichiometric or fuel-rich manner in the top set of burners. The middle set of burners are used to introduce the additional requisite amount of air into the furnace to enable complete combustion of all of the fuel, thereby preventing the formation of condensable carbon or smoke. This method of combustion enables fuel-rich burning of essentially all of the fuel within the furnace thereby even further reducing the NOx concentration in combustion effluents. In an alternative embodiment, a plurality of air inlet ports can be utilized to introduce additional air into the furnace. The air is introduced into the furnace between the two sets of burners or on the same level as the top set of burners. Preferably, the air is introduced into the furnace directly above the bottom set of burners.

Not to be bound by theory, it is believed that reduced nitrogen oxide emissions result from the water that is formed when burning an alcohol. The formed water reduces the flame temperature which results in reduced thermal NOx formation.

EXAMPLE

Tests were conducted to compare NOx emissions from burning methanol/natural gas simultaneously against burning methanol only or natural gas only. The procedures and test results are described in detail in A. Weir, Jr., W. H. Von KleinSmid, E. A. Danko, and N. J. Kertamus, "Investigation of Methanol as a Boiler Fuel for Electric Power Generation", EPRI AP-2554, August, 1982.

These tests were conducted in the Highgrove Generation Station of Southern California Edison. Highgrove Boiler 4, used in the methanol test program, is a drum type non-reheat boiler manufactured by Combustion Engineering. This wall-fired boiler is designed to produce 425,000 pounds per hour of steam at 1250 psig and 950° F. The balanced draft boiler has two rows of three burners positioned on the front face of the unit and each burner releases 85 million Btu's of heat per hour. The boiler is approximately 20 feet square and 46 feet tall.

The boiler is a once through unit without steam reheat. The superheated steam temperature of 950° F. is attained by routing the steam through a primary and secondary superheater. Superheat attemperation is accomplished by routing water from the economizer through the spray attemperator to quench excessive superheat temperatures. The bottom of the boiler is refractory lined with refractory on the side-walls to support the water tubes. The flue gas provides air preheat by a rotating regenerative air heater.

The tests were conducted with Racer burners, manufactured by The Babcock and Wilcox Company. For the methanol/natural gas test at a rate of 30 mw, a mechanically atomized burner was used. For all other tests, steam atomized burners were used.

During the methanol/natural gas test, methanol was burned in the top row of three burners and natural gas was burned in the bottom row of three burners. The results from the tests are presented in the following table:

| | NOx Emissions for Different Fuels | | |
|---|---|---|---|
| | Methanol Only | Natural Gas Only | Methanol/ Natural Gas |
| Full load | 82 | 240 | 183 |
| 30 MW | 65 | 152 | 70 |

Although the present invention has been described in considerable detail with reference to certain preferred versions thereof, other versions are possible. Therefore the spirit and scope of the appended claims should not necessarily be limited to the description of the preferred versions contained herein.

What is claimed is:

1. A method for reducing nitrogen oxide emissions from burning a fuel containing essentially no nitrogen comprising the steps of:

(a) burning a fuel containing essentially no nitrogen in a first burner means; and (b) burning alcohol simultaneously in a second burner means, the second burner means being positioned above the first burner means so that the combustion gases from burning the fuel containing essentially no nitrogen pass through the combustion zone of the second burner means.

2. The method of claim 1 in which the fuel containing essentially no nitrogen is natural gas.

3. A method for reducing nitrogen oxide emissions from burning a fuel containing essentially no nitrogen comprising the steps of:

(a) burning in a first combustion zone a fuel containing essentially no nitrogen in a fuel-rich manner;

(b) burning in a second combustion zone alcohol in an air-rich manner; and (c) burning both the fuel containing essentially no nitrogen and the alcohol in a manner to cause the combustion gases from burning the fuel containing essentially no nitrogen to pass through the second combustion zone.

4. The method of claim 3 in which the fuel containing essentially no nitrogen is natural gas.

5. A method for reducing nitrogen oxide emissions from burning a fuel contaning essentially no nitrogen, comprising:

(a) burning in a first combustion zone a fuel containing essentially no nitrogen in a stoichiometric manner;

(b) burning in a second combustion zone alcohol in a stoichiometric manner; and (c) burning both the fuel containing essentially no nitrogen and the alcohol simultaneously and in a manner to cause the combustion gases from burning the fuel containing essentially no nitrogen to pass through the second combustion zone.

6. The method of claim 5 in which the fuel containing essentially no nitrogen is natural gas.

7. The method for reducing nitrogen oxide emissions from burning a fuel containing essentially no nitrogen comprising the steps of:

(a) burning in a first combustion zone of a furnace the fuel containing essentially no nitrogen in a fuel-rich manner;

(b) burning in the second combustion zone of the furnace alcohol in a fuel-rich manner;

(c) introducing air into the furnace between first and second combustion zones to enable complete combustion of the alcohol and the fuel contaning essentially no nitrogen; and (d) burning both the alcohol and the fuel containing essentially no nitrogen simultaneously and in a manner to cause the combustion gases from the burning of the fuel containing essentially no nitrogen to pass through the second combustion zone.

8. The method of claim 7 in which the fuel containing essentially no nitrogen is natural gas.

9. A method for reducing nitrogen oxide emissions from burning a fuel containing essentially no nitrogen comprising the steps of:

(a) burning in a first combustion zone of a furnace the fuel containing essentially no nitrogen in a fuel-rich manner;

(b) burning in a second combustion zone of a furnace alcohol in a stoichiometric manner;

(c) introducing air into the furnace between the first and second combustion zones to enable complete combustion of the fuel containing essentially no nitrogen and the alcohol; and (d) burning both the fuel containing essentially no nitrogen and the alcohol simultaneously and in a manner to cause the combustion gases from the burning of the fuel containing substantially no nitrogen to pass through the second combustion zone.

10. The method of claim 9 in which the fuel containing essentially no nitrogen is natural gas.

11. The method of claim 1 in which the alcohol is methanol.

12. The method of claim 3 in which the alcohol is methanol.

13. The method of claim 7 in which the alcohol is methanol.

14. The method of claim 9 in which the alcohol is methanol.

* * * * *